US007316623B2

(12) United States Patent
Imamoto

(10) Patent No.: US 7,316,623 B2
(45) Date of Patent: Jan. 8, 2008

(54) GOLF CLUB HEAD

(75) Inventor: Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 203 days.

(21) Appl. No.: 11/067,922

(22) Filed: Mar. 1, 2005

(65) Prior Publication Data

US 2005/0197208 A1 Sep. 8, 2005

(30) Foreign Application Priority Data

Mar. 1, 2004 (JP) ..... 2004-056393

(51) Int. Cl.
*A63B 53/04* (2006.01)

(52) U.S. Cl. ..... 473/332; 473/473; 473/349; 473/350

(58) Field of Classification Search ..... 473/324–350
See application file for complete search history.

(56) References Cited

U.S. PATENT DOCUMENTS

| | | | | |
|---|---|---|---|---|
| 2,163,091 | A * | 6/1939 | Held | 473/338 |
| 2,846,228 | A | 8/1958 | Reach | |
| 3,749,408 | A * | 7/1973 | Mills | 473/336 |
| 4,508,350 | A * | 4/1985 | Duclos | 473/254 |
| 4,695,054 | A * | 9/1987 | Tunstall | 473/338 |
| 4,804,188 | A * | 2/1989 | McKee et al. | 473/342 |
| 4,824,110 | A * | 4/1989 | Kobayashi | 473/332 |
| 4,928,972 | A * | 5/1990 | Nakanishi et al. | 473/332 |
| 5,050,879 | A * | 9/1991 | Sun et al. | 473/338 |
| 5,082,278 | A * | 1/1992 | Hsien | 473/242 |
| 5,106,094 | A * | 4/1992 | Desbiolles et al. | 473/342 |
| 5,290,036 | A | 3/1994 | Fenton et al. | |
| 5,316,298 | A | 5/1994 | Hutin et al. | |
| 5,445,382 | A * | 8/1995 | Pearce et al. | 473/342 |
| 5,529,543 | A * | 6/1996 | Beaumont, Sr. | 473/290 |
| 5,669,826 | A * | 9/1997 | Chang et al. | 473/332 |
| 5,766,092 | A | 6/1998 | Mimeur et al. | |
| 6,012,990 | A | 1/2000 | Nishizawa | |
| 6,030,293 | A | 2/2000 | Takeda | |
| 6,045,456 | A | 4/2000 | Best et al. | |
| 6,077,171 | A | 6/2000 | Yoneyama | |
| 6,210,290 | B1 | 4/2001 | Erickson et al. | |
| 6,475,427 | B1 | 11/2002 | Deshmukh et al. | |
| 6,592,469 | B2 * | 7/2003 | Gilbert | 473/350 |
| 6,835,144 | B2 * | 12/2004 | Best | 473/332 |
| 7,086,964 | B2 * | 8/2006 | Chen et al. | 473/350 |
| 7,182,698 | B2 * | 2/2007 | Tseng | 473/332 |
| 2002/0022535 | A1 | 2/2002 | Takeda | |
| 2003/0236134 | A1 | 12/2003 | Nishitani | |

(Continued)

FOREIGN PATENT DOCUMENTS

| | | | |
|---|---|---|---|
| GB | 347502 | * | 4/1931 |

(Continued)

*Primary Examiner*—Sebastiano Passaniti
(74) *Attorney, Agent, or Firm*—Sughrue Mion, PLLC

(57) ABSTRACT

A golf club head has a head main body, an elastic body, and a lid body. The head main body has a back surface and a sole surface, and defines a recess portion depressed from one of the back surface and the sole surface. The elastic body is fixed in the recess portion in an compressed state and defines an empty portion. The lid body is attached to an entrance portion of the recess portion.

15 Claims, 4 Drawing Sheets

U.S. PATENT DOCUMENTS

| | | | | |
|---|---|---|---|---|
| 2004/0043830 | A1 | 3/2004 | Imamoto | |
| 2005/0192116 | A1* | 9/2005 | Imamoto | 473/329 |
| 2005/0277485 | A1* | 12/2005 | Hou et al. | 473/332 |

FOREIGN PATENT DOCUMENTS

| | | | |
|---|---|---|---|
| GB | 1387955 | * | 3/1975 |
| JP | 06-304273 | A | 11/1994 |
| JP | 7-213656 | A | 8/1995 |
| JP | 9-24125 | A | 1/1997 |
| JP | 9-117537 | A | 5/1997 |
| JP | 9-215795 | A | 8/1997 |
| JP | 9-276455 | A | 10/1997 |
| JP | 10-277180 | A | 10/1998 |
| JP | 2000-157653 | A | 6/2000 |
| JP | 2000-176056 | A | 6/2000 |
| JP | 2002-102399 | A | 4/2002 |
| JP | 2003-33453 | A | 2/2003 |

* cited by examiner

GOLF CLUB HEAD

BACKGROUND OF THE INVENTION

1. Field of the Invention

The present invention relates to a golf club head, and more particularly to a golf club head in which a golf club head, which defines a hollow portion in which an elastic body is disposed.

2. Description of the Related Art

JP-A-Hei.9-24125 describes a golf club head in which a rubber, a rubber-like elastic body or a spring is provided in a hollow portion defined between a face surface and a back surface of the golf club head. JP-A-Hei.9-24125 also describes that the rubber is disposed in a slightly compressed state.

SUMMARY OF THE INVENTION

The golf club head of JP-A-Hei.9-24125 was made to attempt to increase the driving distance by causing the elastic body to behave elastically at the time of impact.

An object of the invention is to provide a golf club head in which the elastic body absorbs vibrations generated at the time of impact so as to improve the feeling of hitting a golf ball.

According to one embodiment of the invention, a golf club head has a head main body, an elastic body, and a lid body. The head main body has a back surface and a sole surface, and defines a recess portion depressed from one of the back surface and the sole surface. The elastic body is fixed in the recess portion in an compressed state and defines an empty portion. The lid body is attached to an entrance portion of the recess portion.

Since in the golf club head, the elastic body is fixed in the recess portion in the compressed state in such a manner that the elastic body is in close contact with an interior surface of the recess portion, vibrations generated at the time of hitting a golf ball are propagated to the elastic body with good efficiency. Since the empty portion is provided in this elastic body, when the vibrations so generated have propagated to the elastic body, the elastic body vibrates in such a manner as to cause the volume of the empty space to fluctuate so as to absorb the vibrations so propagated thereto. Due to this, the feeling of hitting a golf ball felt at the time of impact can be improved.

If the empty portion has a volume in a range of 2% to 20% of that of the elastic body, the vibrations absorbing action is exhibited sufficiently.

In the invention, the lid body may be made of a metal having a specific gravity being equal to or larger than 10. With this configuration, the center of gravity of the golf club head can be deepened and lowered.

A recessed step portion may be formed at the entrance portion of the recess portion so that an opening area of the recessed step portion is larger than that of a deepest side of the recess portion. The lid body may be fitted in the recessed step portion.

The invention may be applied to an iron golf club head. Note that the iron golf club head includes a utility golf club head whose shape approximates to that of the iron golf club head. The utility golf club head is a golf club head, which is bigger in a depth-wise dimension than the iron golf club head but is not as large in the depth-wise length as a wooden golf club head.

A thickness of the face portion between the recess portion and a face surface of the golf club head may be in a range of 1.5 mm to 2.5 mm, and a contact area between the elastic body and the face portion may be in a range of 100 $mm^2$ to 300 $mm^2$. With this configuration, vibrations generated from the face surface at the time of impact is allowed to propagate sufficiently to the elastic body so as to be absorbed sufficiently by the elastic body. In addition, by making the face portion thin, the face surface is allowed to be deformed elastically at the time of impact so as to improve the repulsion characteristics of a golf ball.

The elastic body may have 15 to 80 in JIS C hardness. Thereby, a feeling of hitting a golf ball felt by a player when he or she hits the golf ball is improved.

The elastic body may contain a thermoplastic elastomer.

The invention provides a golf club head, which provides a good feeling of hitting a golf ball.

DETAILED DESCRIPTION OF THE PREFERRED EMBODIMENTS

An embodiment of the invention will be described below with reference to the drawings.

Figure 1:
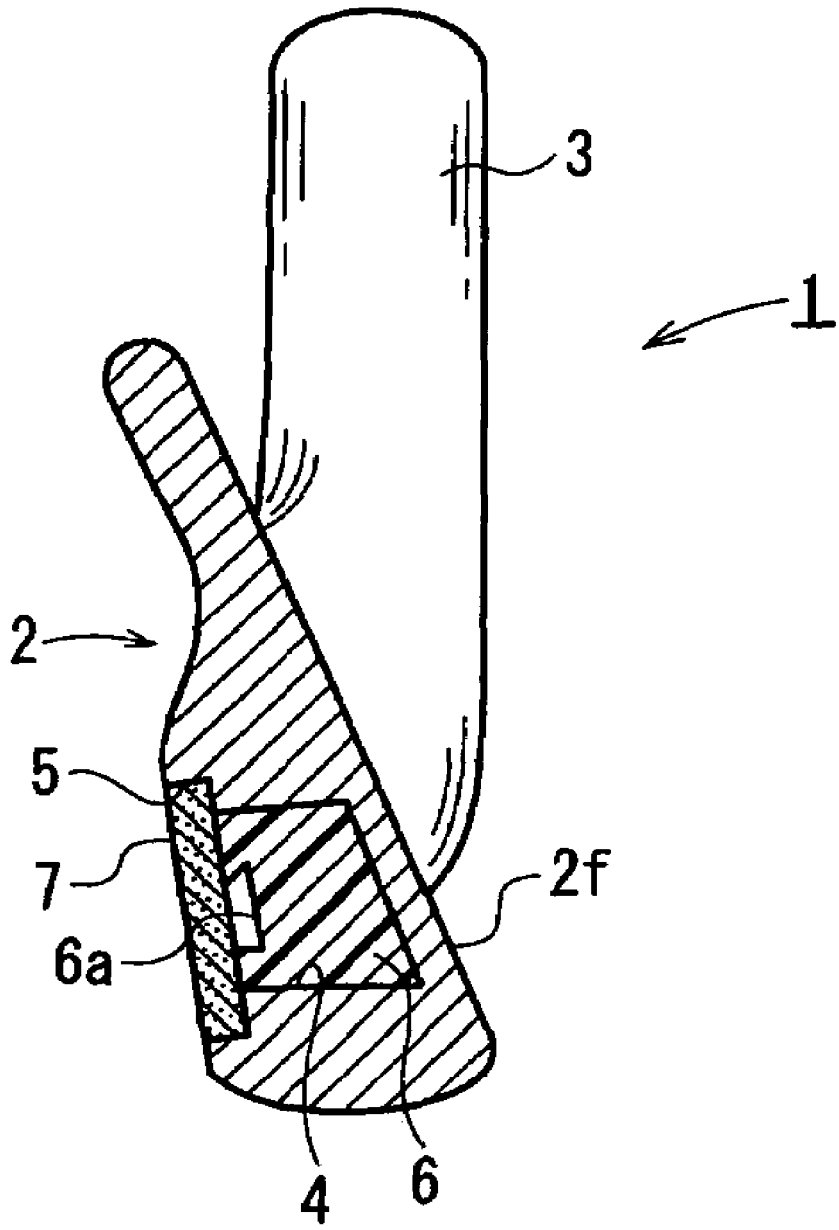
FIG. 1 is a vertical cross-sectional view of a golf club head according to an embodiment of the invention cut at a widthwise center of a face thereof.
Figure 2:
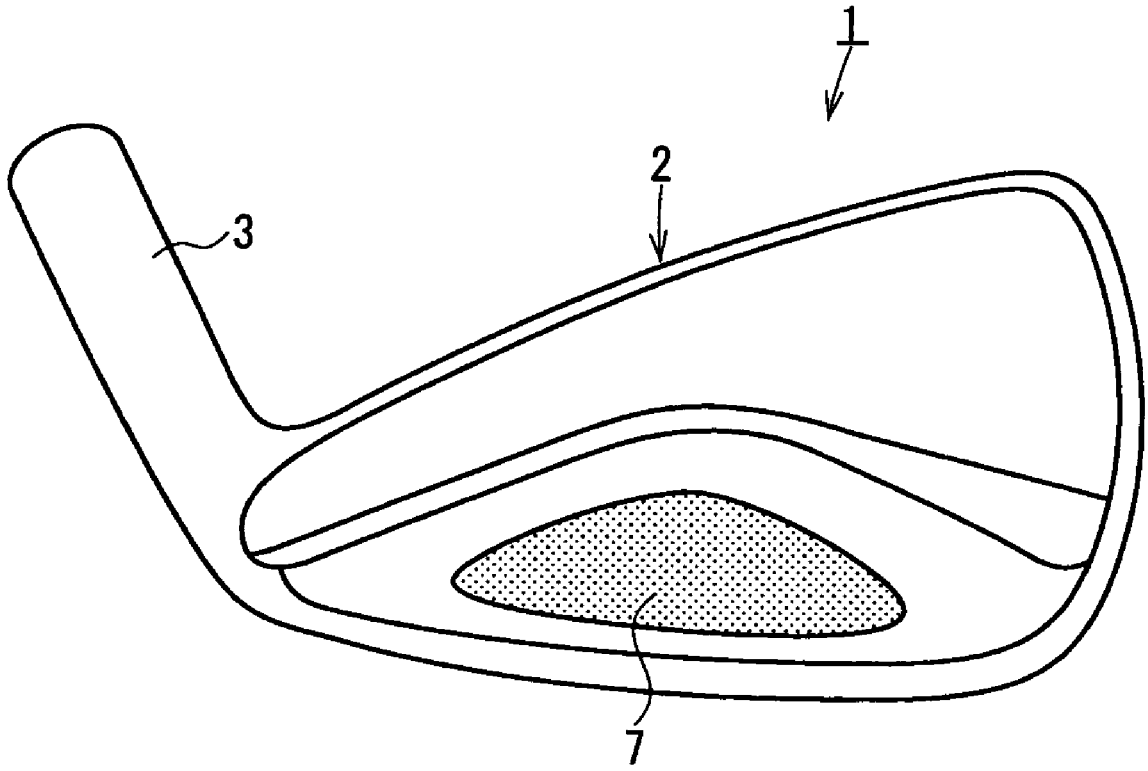
FIG. 2 is a perspective view of a head main body as seen from a back side thereof and slightly therebelow.
Figure 3:
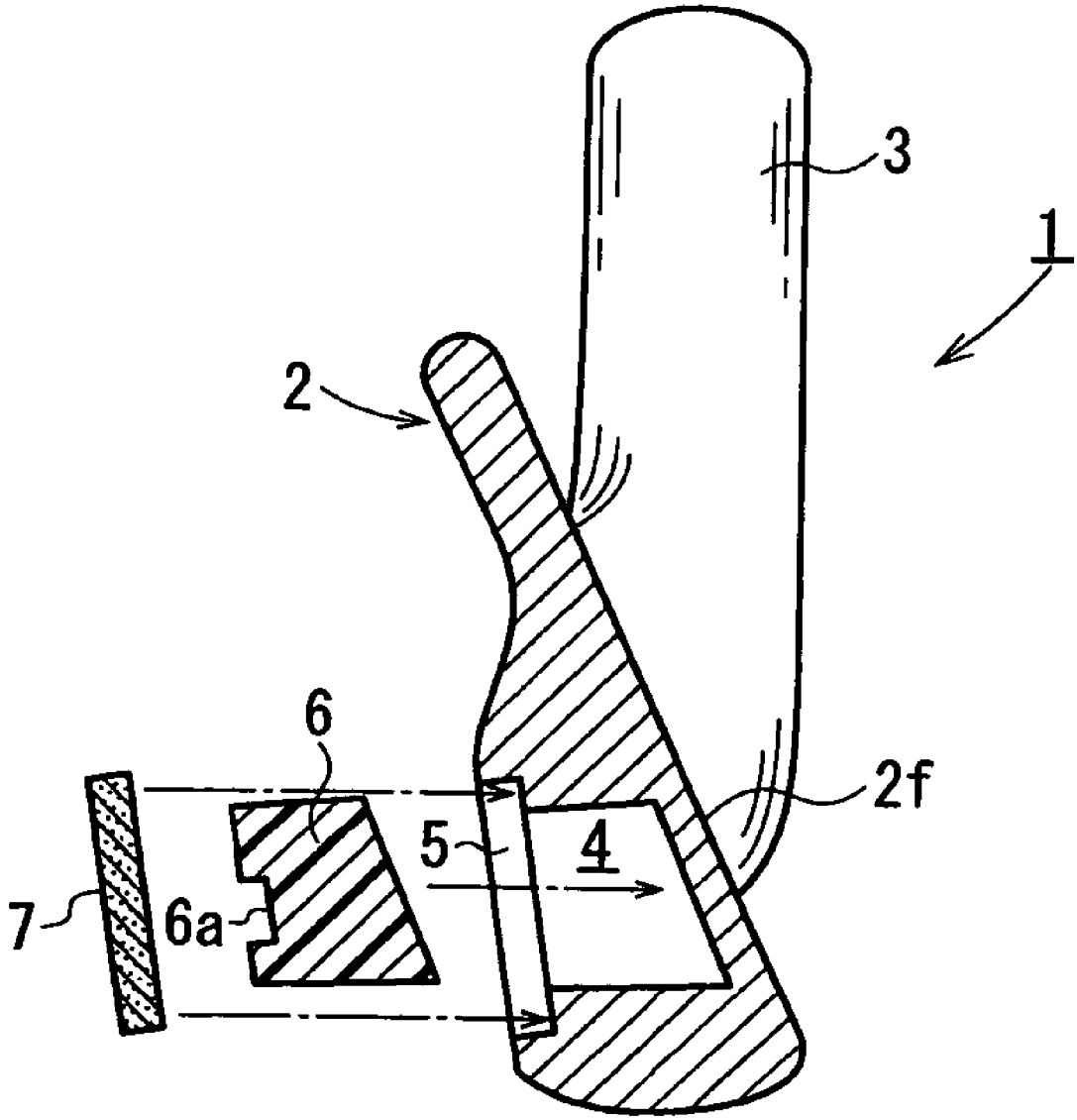
FIG. 3 is an exploded view of FIG. 1.

FIG. 1 is a vertical cross-sectional view of a golf club head according to an embodiment of the invention cut at a widthwise center of a face thereof. FIG. 2 is a perspective view of a head main body as seen from a back side thereof and slightly therebelow. FIG. 3 is an exploded view of the golf club head in the cross section shown in FIG. 1.

A golf club head 1 according to the embodiment has a head main body 2 and a hose 1 portion 3, which is made integral with the head main body 2. A front side of the head main body 2 constitutes a face portion 2*f*.

A lower portion of the head main body 2 is made thicker than an upper portion thereof. A recess portion 4 is defined in a depressed fashion from a back side of the lower portion of the head main body 2. A wall surface on a deepest side of the recess portion 4 is made substantially parallel to the face portion 2*f*. A thickness between the deepest-side wall surface and the face portion 2*f* is preferably in a range of 1 mm to 2.5 mm, and more preferably in a range of 1.5 mm to 2.1 mm.

An entrance of the recess portion 4 defines a recessed step portion 5 whose opening area is larger than the deepest side of the recess portion 4. A lid body 7 is fitted in the recessed step portion 5 after an elastic body 6 has been elastically inserted in the recess portion 4, and the lid body 7 is fixed therein by crimping, caulking, or press fit system.

When fixing the lid body 7 by caulking, after the lid body 7 has been fitted in the recessed step portion 5, a periphery of the recessed step portion 5 is crimped to be deformed.

When fixing the lid body 7 by press fit, the lid body 7, which is extremely slightly bigger than the recessed step portion 5, only has to be forced to fit in the recessed step portion 5. Note that the lid body 7 may be fixed in the recessed step portion 5 by expansion fit.

The recessed step portion 5 has a shape resulting by cutting away a circumferential edge portion of the entrance of the recess portion 4 in a range of 2 mm to 4 mm in depth and in a range of 2 mm to 4 mm in width.

The lid body 7 is mounted in such a manner that an exterior side thereof becomes flush with the back side of the head main body 2.

The recess portion 4 preferably has a toe-heel direction width, which falls in a range of 30% to 90% of a toe-heel direction width of the head main body 2. Note that the toe-heel direction width means a maximum width in the toe-heel direction.

A vertical direction width (a maximum width in a direction parallel to the face side) of the recess portion 4 is preferably in a range of 3 mm to 25 mm. A vertical maximum width portion of the recess portion 4 is desirably positioned in the vicinity of a face center (namely, a longitudinal center of a corrugation provided in the face side).

The elastic body 6 is present at the longitudinal center of corrugations (grooves) in the face surface. Also, it is preferable that the elastic body 6 exists in an area that hits ball when a golf ball is shot properly (at times other than mishittings such as duffing, toping and shanking). Consequently, from the fact that the diameter of a golf ball is 42.67 mm, the elastic body 6 preferably exists at a widthwise center of the golf club head at a hitting height HT defined by the following equation.

$$HT(\text{mm})=42.67/2(1-\sin\theta)$$

where, θ is the loft angle of the golf club head.

In this embodiment, the recess portion 4 is configured so as to form a triangle, which protrudes upwardly at the center of the face widthwise direction, whereby the existence of the elastic body 6 at the hitting height HT is ensured. Upper sides of the recess portion 4 are configured such that they lower in height on both sides of the central portion as they are away from the central portion, whereby the center of gravity of the golf club head is lowered.

It is preferable that the volume (excluding that of the recessed step portion 5) of the recess portion 4 is in a range of 10% to 50% of that of the head main body 2, and more preferably in a range of 15% to 30% of that of the head main body 2.

Elastomers having elasticity are preferred for the material of the elastic body 6 and include, for example, styrene elastomer, olefin elastomer, urethane elastomer, ester elastomer, amide elastomer, 1,2-polybutadiene, ionomer resin, transpolyisoprene and halogenated elastomer. In particular, styrene elastomer, urethane elastomer, amide elastomer, 1,2-polybutadiene, fluorinated butyl rubber are preferred.

In a case where a thermoplastic elastomer is used as the elastomer, the softening temperature thereof is preferably 80° C. or higher. This is because the plastic deformation of the elastomer used in a golf club stowed in the boot of an automobile is prevented.

In a case where the elastic body 6 has a hardness in a range of from JIS C 15 to JIS C 80, in particular, in a range of from JIS C 18 to JIS C 70, and above all, in a range of from JIS C 20 to JIS C 60, the ball hitting feeling of the golf club head 1 is improved.

The elastic body 6 defines an empty space 6*a*. This empty space 6*a* remains as an empty space even after the elastic body 6 is pressed against by the lid body 7. The volume of this empty space is preferably in a range of 2% to 20% of that of the elastic body 6, and in particular, in a range of 3% to 10% of that of the elastic body 6 in a state where the elastic body 6 is disposed in the interior of the head main body 2 and the lid body 7 is mounted.

This empty space 6*a* is preferably provided in other sides than a front side (a side facing the face portion 2*f*) of the elastic body 6, that is, in a top side, a bottom side or a back side of the elastic body 6. This increases the contact area of the elastic body 6 with the face portion 2*f* so as to facilitate the propagation of vibrations from the face portion 2*f* to the elastic body 6.

Stainless steel, maraging steel, a copper alloy such as brass, a beryllium copper and bronze, titan, a titanium alloy, duralumin and a high-strength aluminum alloy, an amorphous alloy and FRM are raised as examples of materials for the head main body 2.

In the embodiment of the invention, two or more kinds of materials may be combined, e.g., in such a way that the face portion 2*f* is formed of titan or a titanium alloy, and the other portions are formed of stainless steel.

The depth of center of gravity of a golf club head in which a head main body is made of stainless steel or mild steel (of a specific gravity of 7.8) and a face portion is made of a titanium alloy (of a specific gravity of 4.2 to 5.0) or duralumin (of a specific gravity of 2.8) becomes deep. A face plate of a copper alloy increases the amount of backspin of a golf ball shot by the golf club head 1. Since a face plate of Zr amorphous alloy has a low Young's modulus of about 85 GPa to 100 GPa, the restitution coefficient of a golf club head having this face plate is increased, so that the initial speed of a golf ball hit by the gold club head is increased.

In a golf club head having a face plate whose Young's modulus is low, the face plate tends to deflect largely at the time of impact. However, the elastic body 6 disposed behind the face plate prevents the large deflection of the face plate and suppresses the vibration of the face plate.

A metal material of a high specific gravity (preferably a specific gravity of 10 or greater, in particular, a specific gravity of 11 or greater) such as tungsten and a tungsten alloy is preferable for the lit body 7.

When assembling the golf club head 1, the elastic body 6, which is slightly larger in size than the recess portion 4, is fitted in the recess portion 4. By being fitted in this way, the front side of the elastic body 6 is brought into abutment with the wall surface on the deepest side of the recess portion 4 and a rear side thereof protrudes slightly (preferably, 2% to 50%, and more preferably, 5% to 15% of the thickness of the elastic body 6) from the recess portion 4. Next, the lid body 7 is crimped in the recessed step portion 5 and is fixedly fitted therein via press fit or the like. The elastic body 6 is pressed by the lid body 7 to thereby be fixed in the interior of the recess portion 4 in the compressed state. Then, the entirety of the front side of the elastic body 6 is in close contact with the face plate 40.

In the golf club head 1 constructed as has been described above, since the elastic body 6 is fixed in the interior of the recess portion 4 in the compressed state and the entirety of the front side of the elastic body 6 is in close contact with the face portion 2*f*, vibrations generated at the time of impact are absorbed by the elastic body 6 to thereby improve the feeling of hitting a golf ball.

In this embodiment, the empty space 6*a* is defined in the elastic body 6, and the elastic body 6 elastically deforms in such a manner as to decrease and increase the volume of the empty space 6*a* at the time of hitting a golf ball, whereby vibrations generated in the golf club head 1 by hitting the golf ball are absorbed. In addition, an effect on change in hardness due to the temperature dependence of the elastic body 6 itself can be reduced.

While, in the above embodiment, the empty space 6*a* is defined in the exterior surface of the elastic body 6, the empty space 6*a* may be defined in the interior of the elastic body 6. In addition, the empty space 6*a* may be defined by providing a depressed portion in the head main body 2 or the lid body 7.

Note that in this embodiment, since the lid body 7 made of the metal material of a high specific gravity is positioned on a back side of the head main body 2, the depth of the center of gravity of the head main body 2 becomes deep.

Figure 4:
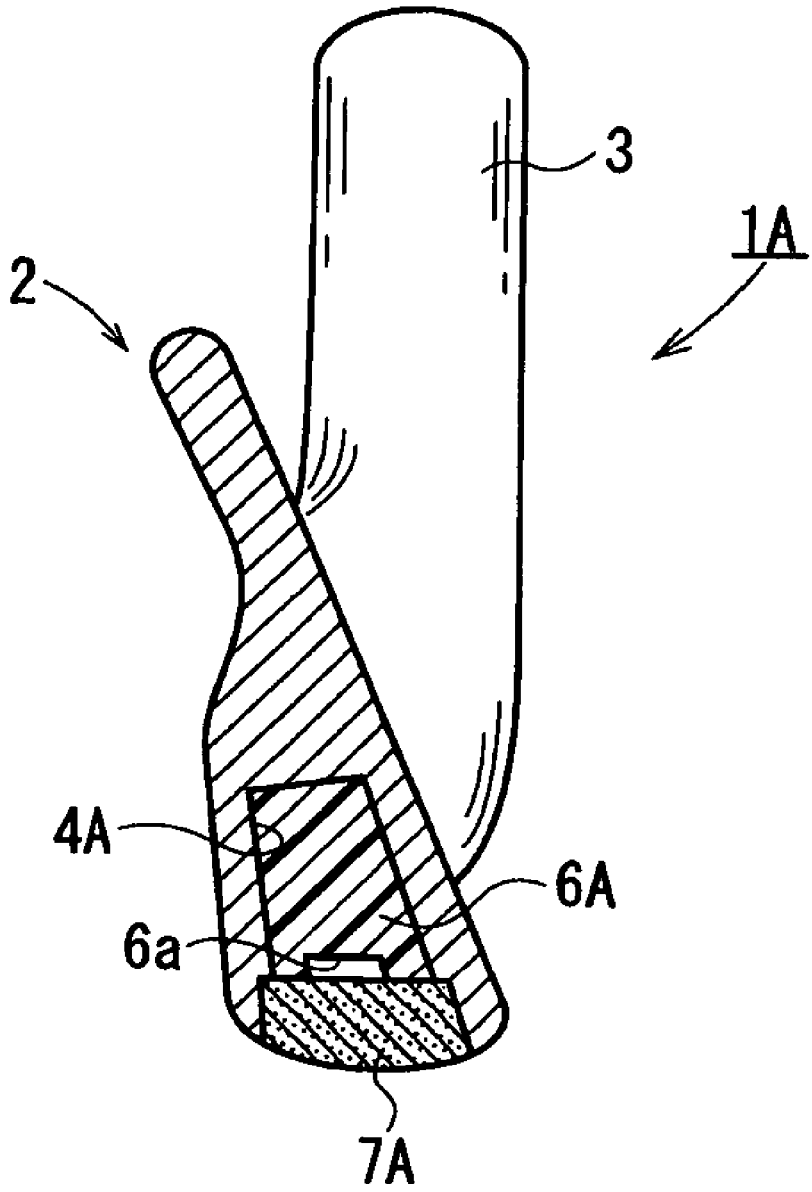
FIG. 4 is a vertical cross-sectional view of a golf club head according to another embodiment of the invention cut at a widthwise center of a face thereof.

In the above embodiment, the recess portion 4 is provided in such a manner as to be depressed from the back side of the head main body 2 towards the front thereof. However, as in a golf club head 1A shown in FIG. 4, a recess portion 4A may be defined in such a manner as to be depressed upwardly from a sole portion of the head main body 2. Also, a lid body 7A may be disposed in the sole portion. In this case, while an empty space 6*a* is defined in a lower bottom portion of an elastic body 6A, the empty space 6*a* may be defined in a back side or upper side of the elastic body 6A.

What is claimed is:

1. A golf club head comprising:

a head main body that comprises a back surface and a sole surface, the head main body defining a recess portion depressed from one of the back surface and the sole surface;

an elastic body that is fixed in the recess portion in a compressed state and defines an empty portion; and a lid body attached to an entrance portion of the recess portion; wherein a recessed step portion is formed at the entrance portion of the recess portion so that an opening area of the recessed step portion is larger than that of a deepest side of the recess portion; and the lid body is fitted in the recessed step portion.

2. The golf club head according to claim 1, wherein the empty portion has a volume in a range of 2% to 20% of that of the elastic body.

3. The golf club head according to claim 1, wherein the lid body is made of a metal having a specific gravity being equal to or larger than 10.

4. The golf club head according to claim 1, wherein the lid body is press-fitted in the recessed step portion.

5. The golf club head according to claim 1, wherein the lid body is fixed to the recessed step portion by caulking circumferential edge portion of the recessed step portion.

6. The golf club head according to claim 1, wherein the elastic body comprises a thermoplastic elastomer.

7. The golf club head according to claim 1, wherein the elastic body has 15 to 80 in JIS C hardness.

8. The golf club head according to claim 1, wherein the golf club head further comprises a face portion and the empty portion that is defined by the elastic body is on a side other than a side facing the face portion.

9. The golf club head according to claim 1, wherein the golf club head further comprises a face portion, and wherein a surface of the body contacts a back side of the face portion.

10. The golf club head according to claim 1, wherein the lid body includes tungsten or a tungsten alloy.

11. The golf club head according to claim 1, further comprising:

a face portion between the recess portion and a face of the golf club heady; and a contact area between the elastic body and the face portion.

12. The golf club head according to claim 1, wherein the head main body includes at least one selected from the group consisting of stainless steel, maraging steel, a copper alloy, titanium, a titanium alloy, duralumin, a high-strength aluminum alloy, an amorphous alloy and FRM.

13. The golf club head according to claim 1, further comprising a face portion between the recess portion and a face surface of the golf club head, wherein the head main body includes stainless steel or mild steel, and wherein the face portion includes at least one selected from the group consisting of titanium alloy, duralumin, a copper alloy and a ZR amorphous alloy.

14. A golf club head comprising:

a head main body that comprises a back surface and a sole surface, the head main body defining a recess portion depressed from one of the back surface and the sole surface;

an elastic body that is fixed in the recess portion in a compressed state and defines an empty portion; and a lid body attached to an entrance portion of the recess portion;

wherein the elastic body is present at least at a center in a width direction of the golf club head at a height HT expressed by the following formula:

$$HT(\text{mm})=42.67/2(1-\sin\theta),$$

where θ represents a loft angle of the golf club head.

15. A golf club head comprising:

a head main body that comprises a back surface and a sole surface, the head main body defining a recess portion depressed from one of the back surface and the sole surface;

an elastic body that is fixed in the recess portion in a compressed state and defines an empty portion; and a lid body attached to an entrance portion of the recess portion:

further comprising a face portion, wherein:

a thickness of the face portion between the recess portion and a face surface of the golf club head is in a range of 1.5 mm to 2.5 mm; and a contact area between the elastic body and the face portion is in a range of 100 $mm^2$ to 300 $mm^2$.

* * * * *